United States Patent [19]

Mims et al.

[11] Patent Number: 4,756,578

[45] Date of Patent: Jul. 12, 1988

[54] APPARATUS FOR REMOVING SHINGLES AND THE LIKE

[76] Inventors: Clay W. Mims, French Village, Suite 220-9, 2301 Midwestern Parkway, Wichita Falls, Tex. 76308; Francis A. Theroux, 4110 Nakomis, Wichita Falls, Tex. 76301

[21] Appl. No.: 37,553

[22] Filed: Apr. 13, 1987

[51] Int. Cl.[4] ..... E04D 15/00; A47L 11/12

[52] U.S. Cl. ..... 299/37; 15/93 R; 30/170

[58] Field of Search ..... 299/36, 37; 15/93 R, 15/93 C; 30/169, 170

[56] References Cited

U.S. PATENT DOCUMENTS

| | | | |
|---|---|---|---|
| 3,251,629 | 5/1966 | Cawley | 299/37 |
| 3,733,637 | 5/1973 | Becker | 299/37 X |
| 4,277,104 | 7/1981 | Sanchez | 299/37 |
| 4,663,995 | 5/1987 | Amundson et al. | 30/169 X |
| 4,691,439 | 9/1987 | Marra | 30/170 |
| 4,699,430 | 10/1987 | Nichols | 299/37 |
| 4,709,479 | 12/1987 | Lavelette | 299/37 X |

FOREIGN PATENT DOCUMENTS

| | | | |
|---|---|---|---|
| 0814603 | 3/1981 | U.S.S.R. | 15/93 R |

*Primary Examiner*—Jerome Massie, IV
*Assistant Examiner*—David J. Bagnell
*Attorney, Agent, or Firm*—James E. Bradley; Melvin A. Hunn

[57] ABSTRACT

An apparatus for removing flat members from a surface uses a wedging pivotal blade. A mobile frame has a blade pivotally attached to its front end. The blade is movable between an upper and a lower position relative to the frame. The blade is positioned to be substantially in contact with the surface when it is in the lower position. An air cylinder will selectively lift the blade from the lower position to the upper position. As the frame is advanced, the blade is wedged between the flat members and the surface. The blade is raised from the lower position to the upper position, separating the flat members from the surface.

10 Claims, 3 Drawing Sheets

APPARATUS FOR REMOVING SHINGLES AND THE LIKE

BACKGROUND OF THE INVENTION

1. Field of the Invention:

This invention relates generally to an apparatus and method for removing flat members such as shingles from a surface such as a roof.

2. Description of the Prior Art:

The removal of flat members from a surface, such as shingles from a roof, or tiles from a floor, can often be a labor-intensive chore. Normally, to remove shingles from a rooftop, a square bottomed garden spade or shovel is wedged between the shingles and the surface. The shovel is worked under the shingles until it catches the roofing nails or tacks. Then the handle end of the shovel is lowered, allowing the scoop end of the shovel to serve as a lever to pry the shingles from the surface.

The removal of any flat member from a surface is hard manual labor. A great deal of stooping, bending, and forcing is required. The process is often time consuming.

SUMMARY OF THE INVENTION

The present apparatus and method saves time and labor when used to remove flat members from a surface.

A mobile frame is provided that has a blade pivotally attached to its front end. The blade is movable between an upper position and a lower position relative to the frame. In the lower position, the blade is substantially in contact with the surface. A means for lifting the blade from the lower position to the upper position is provided.

If the blade is in the lower position and the frame is advanced by the operator, the blade will wedge between the flat members and the surface. When the blade is selectively raised, the flat members are separated from the surface.

DESCRIPTION OF THE PREFERRED EMBODIMENT

Figure 1:
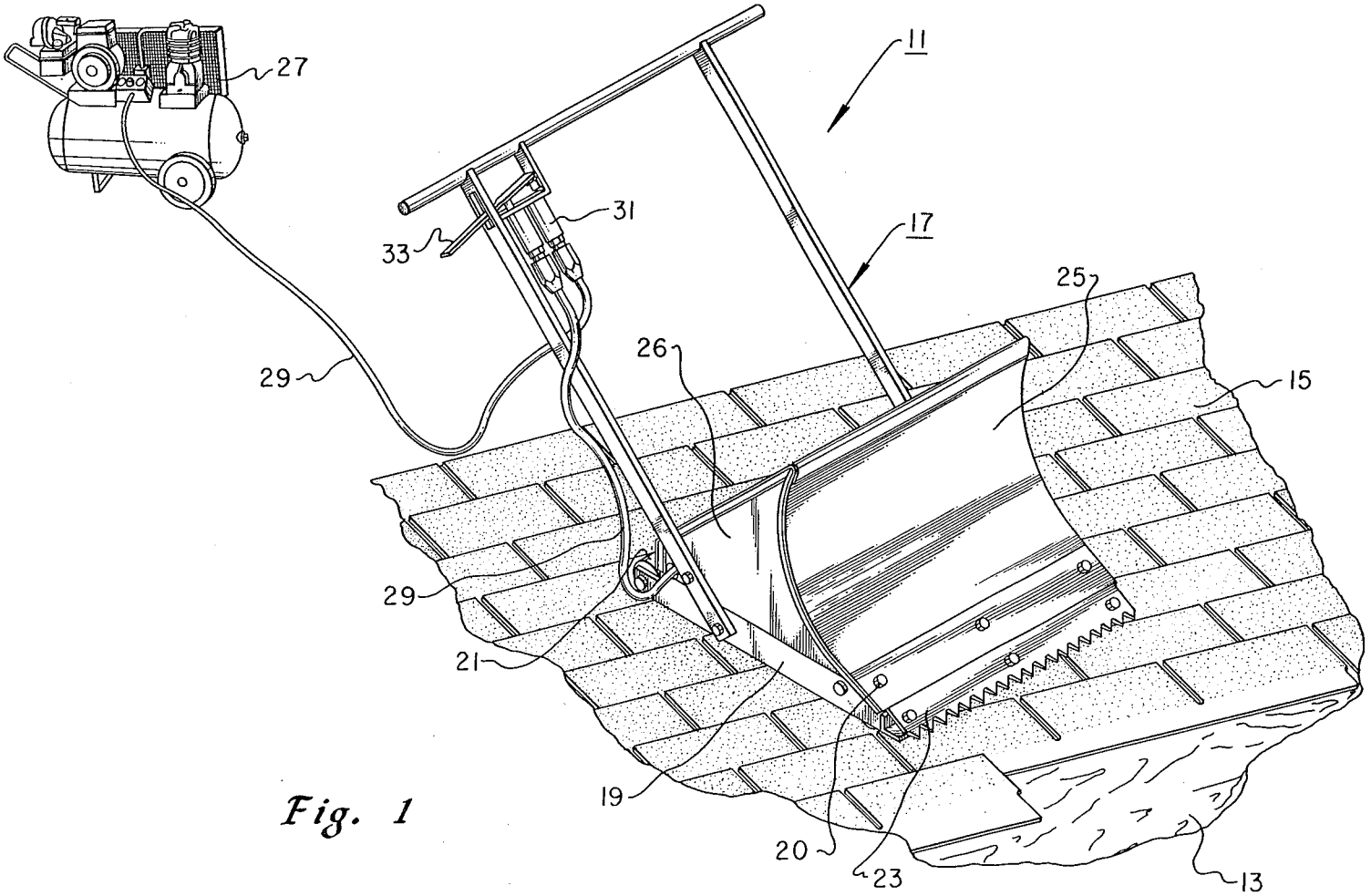
FIG. 1 is a perspective view showing the remover apparatus on a shingled rooftop.

In FIG. 1, the apparatus 11 is depicted as it rests upon rooftop 13. This rooftop 13 is covered with shingles 15.

Figure 2:
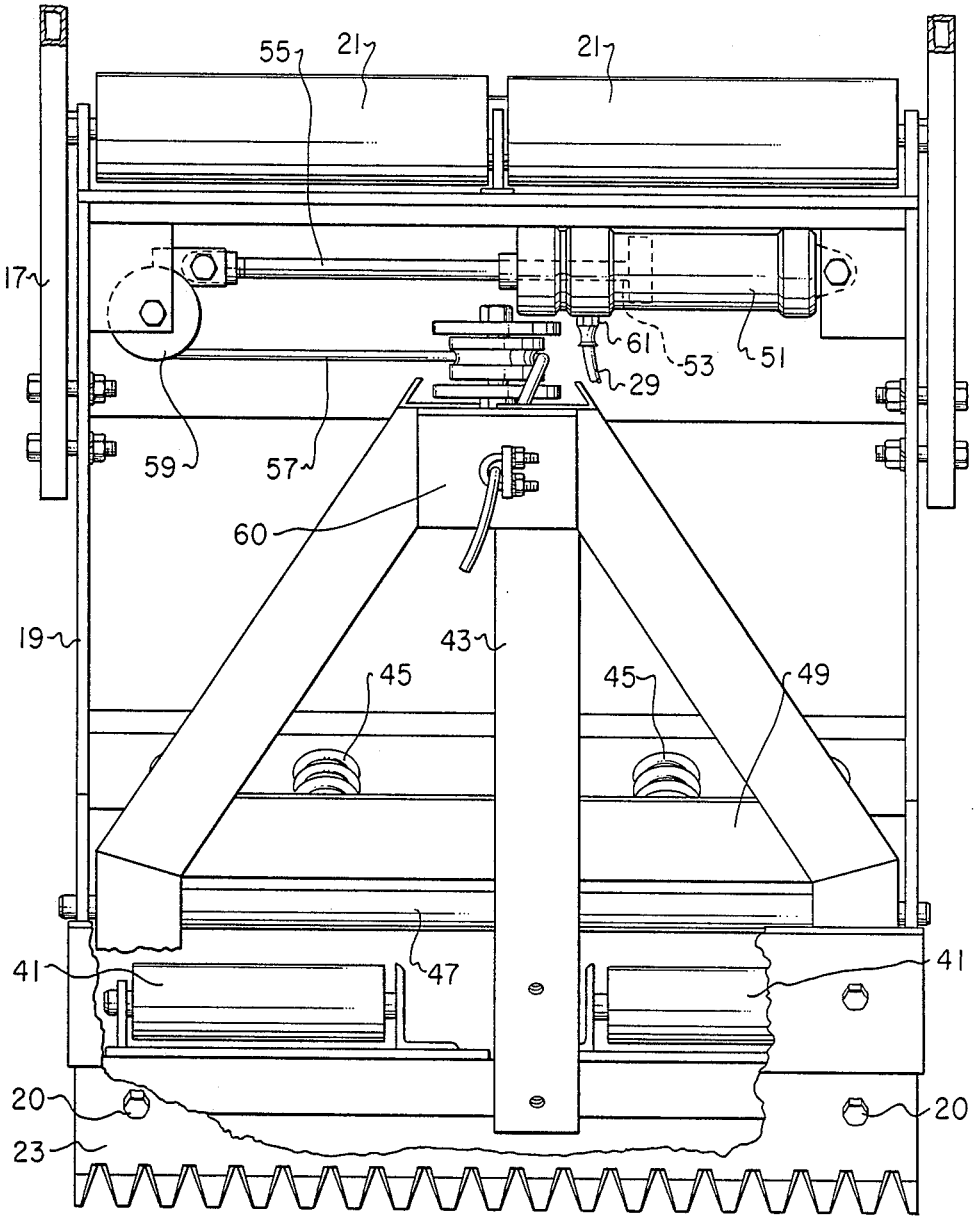
FIG. 2 is a top view of the remover apparatus of FIG. 1, with portions broken away to illustrate the interior.

The apparatus 11 has a handle 17 that extends upward and rearward from the apparatus 11 and allows the operator to push the apparatus 11. The apparatus 11 has a generally rectangular frame 19 to which the handle 17 is mounted. The frame 19 is mounted on rear wheels 21 and front wheels 41 (FIG. 2). A serrated blade 23 is pivotally carried at the forward end. Blade 23 is mounted to a carriage 43 (FIGS. 2 and 3) by a plurality of bolts 20. A housing 26 extends upward from frame 19. A deflecting wall 25 extends upwardly from the frame 19 and rearwardly from the serrated blade 23. Deflecting wall 25 is secured to housing 26 and forms the forward wall of housing 26.

The apparatus 11 is powered by air compressor 27. The air compressor 27 is connected to the apparatus by air hose 29. Air hose 29 directs compressed air through valve 31. The operation of valve 31 is controlled by control lever 33.

Figure 3:
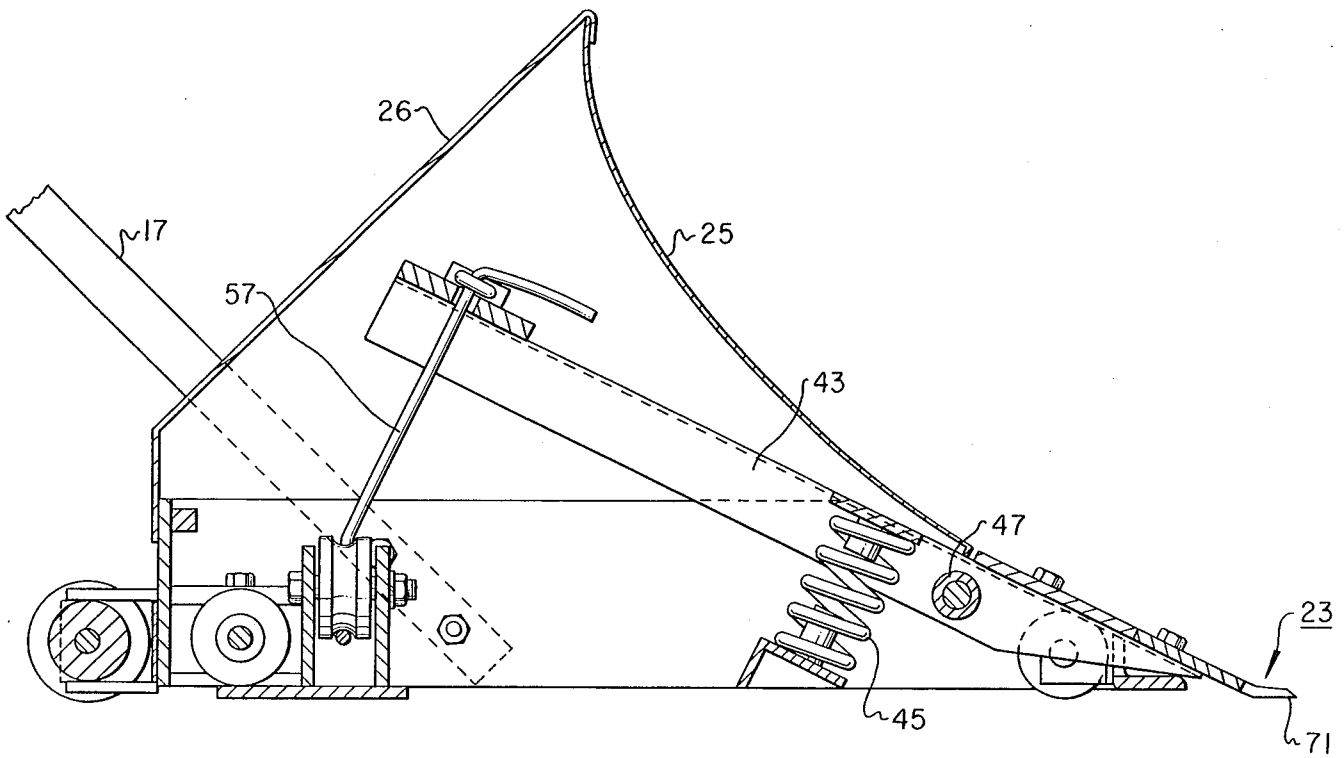
FIG. 3 is a fragmentary vertical cross-sectional view of the remover apparatus of FIG. 1.

Referring to FIG. 2, the front wheels 41 are parallel to the rear wheels 21 and are rotatably mounted to the frame 19. Carriage 43 is carried in the housing 26 and is comprised of rectangular tubular members. Carriage 43 is mounted to frame 19 by a pivot bar 47 which is secured to the frame 19. Springs 45 are mounted between frame 19 and a spring plate 49, which is a part of carriage 43. Springs 45 urge the rearward end of carriage 43 upward and the forward end downward. Blade 23 is rigidly secured to the forward end of carriage 43, forward of pivot bar 47, by bolts 20. As shown in FIG. 3, carriage 43 is located in a plane that is at an acute angle with respect to frame 19 both when the blade 23 is in the upper position and the lower position.

At the rear of frame 19 resides air cylinder 51 and piston 53 with piston shaft 55. Piston shaft 55 is secured to cable 57 which extends through pulley 59. The opposite end of cable 57 is secured to the upper and rearward end of carriage 43 by fastener 60. The cable 57, pulley and fastener 60 serve as linkage means for connecting the piston shaft 55 with the carriage 43. Cylinder 51 has an intake valve 61 through which compressed air is introduced. When air pressure is supplied piston 53 moves to the opposite end, drawing cable 57 and pulling the rearward end of carriage 43 downward.

Referring to FIG. 3, blade 23 has a lower edge 71 that is flat and in parallel contact with the roof 13 when the blade 23 is in the lower position shown. The deflecting wall 25 is concave when viewed from the side. Deflecting wall 25 is rigidly mounted to housing 26, which in turn is rigidly mounted to frame 19. The blade 23 and carriage 43 pivot relative to the wall 25 and housing 26. The forward end of the carriage 43 protrudes forwardly from below the lower edge of the deflecting wall 25.

In operation, referring to FIG. 1, the apparatus 11 is pushed forward by the operator who grips the apparatus by handle 17. When removing shingles 15, the operator starts near the top of the roof 13 and pushes the apparatus downward toward the edge of the roof. As the apparatus 11 is advanced, serrated blade 23 wedges between the rooftop 13 and the shingles 15. Such shingles 15 are often attached to the rooftop through the use of roofing nails, adhesives, or roofing staples (not depicted).

FIG. 3 illustrates that the blade 23 is ordinarily in firm contact with the rooftop 13. Springs 45 act upon spring plate 49, and upon carriage 43 above the pivot bar 47 to urge the rearward end of carriage 43 upward. This upward biasing rearward of the pivot bar 47 urges the lower end of the carriage 43 downward. Since blade 23 is attached to the lower end of carriage 43, the blade will be urged into firm contact with the rooftop 13.

The operator slides the blade 23 under the edge of the shingles 15 while the blade 23 is in the lower position. When the operator wishes to detach the shingles 15 from the rooftop 13, he operates lever 33. Lever 33 allows compressed air to flow from air compressor 27 via air hose 29 to valve 31.

As shown in FIG. 2, when the lever 33 is operated, the compressed air is directed through a lower portion of air hose 29 to intake valve 61 of cylinder 51. The compressed air forces piston 53 toward the inner end of the cylinder 51. The shaft 55 of piston 53 is consequently moved inward with the piston head.

In so doing, the piston shaft 55 pulls cable 57 through pulley 59. Since cable 59 is secured to the upper end of carriage 43 by fastener 60, a downward force is exerted upon carriage 53.

As depicted in FIG. 3, this downward force is sufficient to overcome the springs 45 which bias the carriage upward. This downward force will move the upper end of carriage 43 downward about pivot bar 47, causing serrated blade 23 to be elevated. This lifting or raising of serrated blade 23 will separate the shingles 15 from the rooftop 13. Nails holding the shingles 15 will locate in the serrations of the blade 23. The serrations on blade 23 serve to dislodge any nails or roofing tacks that secure the shingles 15 to the rooftop 13.

Deflecting wall 25 serves to push the loose shingles 15 forward as the frame is advanced. Accordingly, the debris does not impede the forward motion of the apparatus.

This apparatus and method have distinct advantages over the existing ways of removing flat members from a surface. This apparatus and method serve to save labor. The stooping, bending, scraping, and lifting associated with the removal of flat members from a surface are eliminated. This apparatus and method also saves time. A surface can be cleared of flat members with greater speed than before.

While the invention has been described in only one of its forms, it should be apparent to those skilled in the art that it is not so limited, but is susceptible to various changes and modifications without departing from the scope of the invention.

We claim:

1. An apparatus for removing flat members secured to a flat surface, comprising:

a mobile frame;

a carriage pivotally carried by the mobile frame;

a blade pivotally attached to the front of the carriage and movable between an upper position and a lower position relative to the frame, the blade being positioned to be substantially in contact with said surface when in the lower position to allow the blade to be pushed under one of the flat members;

bias means for urging the blade into the lower position;

a pneumatic piston and cylinder carried by said mobile frame;

a source of air pressure connected to the pneumatic cylinder;

a valve means for selectively applying air pressure to the pneumatic cylinder to stroke the piston;

cable connected between the carriage and the piston and cylinder for overcoming said bias means and causing the blade to move to the upper position when air pressure is supplied to the cylinder; and guide means for guiding the cable between the piston and carriage.

2. An apparatus according to claim 1 further comprising a deflecting wall extending upward from the frame and rearward from the blade and at an inclination relative to the blade for deflecting members loosened from said surface.

3. An apparatus for removing flat members secured to a flat surface, comprising:

a mobile frame having a longitudinal axis;

a plurality of wheels for supporting the frame on said surface;

a handle extending upward and rearward from the frame for directing the frame along said surface;

a carriage pivotally mounted to the frame about a pivot point;

a blade rigidly mounted to the carriage forward of the pivot point and being movable between a lower position and an upper position, the blade having a lower portion adapted to contact said surface when in the lower position;

a spring means mounted between the frame and the carriage for urging the rearward end of the carriage upward and the blade to the lower position;

a pneumatic cylinder and piston disposed on said mobile frame traverse to said longitudinal axis of said mobile frame;

a source of air pressure connected to the pneumatic cylinder;

a valve means for selectively applying air pressure to the pneumatic cylinder to stroke the piston;

a pulley disposed on said mobile frame;

a cable connected between the rearward end of the carriage and the piston and cylinder through said pulley for causing the blade to move to the upper position when the air pressure is supplied to the cylinder; and a deflecting wall extending upwardly from the frame and rearward of the blade and at an inclination relative to the blade for deflecting members loosened from said surface.

4. An apparatus according to claim 3 wherein the spring means is located rearward of the pivot point.

5. An apparatus according to claim 3 wherein the deflecting wall is mounted rigid to the frame.

6. An apparatus according to claim 3 wherein the deflecting wall is generally scoop-shaped.

7. An apparatus according to claim 3 wherein the blade has an edge that is serrated to assist in pulling nails that fix the flat members to the surface.

8. An apparatus according to claim 3 wherein the lower portion of the blade is adapted to be parallel to said surface when the blade is in the lower position.

9. An apparatus according to claim 3 wherein the carriage in carried at an acute angle relative to the frame.

10. An apparatus for removing flat members secured to a flat surface, comprising:

a mobile frame having a longitudinal axis;

a plurality of wheels for supporting the frame on said surface;

a handle extending upward and rearward from the frame for directing the frame along said surface;

a carriage pivotally mounted to the frame about a pivot point;

a blade rigidly mounted to the carriage forward of the pivot point and being movable between a lower position and an upper position, the blade having a lower portion adapted to contact said surface when in the lower position;

a spring means mounted between the frame and the carriage for urging the rearward end of the carriage upward and the blade to the lower position;

a pneumatic cylinder and piston disposed on said mobile frame traverse to said longitudinal axis of said mobile frame;

a source of air pressure connected to the pneumatic cylinder;

a valve means for selectively applying air pressure to the pneumatic cylinder to stroke the piston;

a first pulley disposed on said mobile frame adjacent to one end of said pneumatic cylinder and piston;

a second pulley disposed on said carriage;

a cable connected between the rearward end of the carriage and the piston and cylinder through said first and second pulleys for causing the blade to move to the upper position when the air pressure is supplied to the cylinder; and a deflecting wall extending upwardly from the frame and rearward of the blade and at an inclination relative to the blade for deflecting members loosened from said surface.

* * * * *